United States Patent [19]

Schuster

[11] Patent Number: 4,607,484

[45] Date of Patent: Aug. 26, 1986

[54] FRICTION ROTOR FOR THE FALSE-TWISTING OF SYNTHETIC THREADS

[75] Inventor: Friedrich Schuster, Hammelburg, Fed. Rep. of Germany

[73] Assignee: FAG Kugelfischer Georg Schafer (KGaA), Fed. Rep. of Germany

[21] Appl. No.: 796,547

[22] Filed: Nov. 8, 1985

[30] Foreign Application Priority Data

Dec. 22, 1984 [DE] Fed. Rep. of Germany ..... 3447146

[51] Int. Cl.[4] ..... D02G 1/08; D02G 1/04

[52] U.S. Cl. ..... 57/337; 57/334; 57/339

[58] Field of Search ..... 57/332, 334, 337–340, 57/348

[56] References Cited

U.S. PATENT DOCUMENTS

| | | | |
|---|---|---|---|
| 3,901,011 | 8/1975 | Schuster | 57/339 |
| 3,940,914 | 3/1976 | Schuster | 57/339 |
| 4,050,229 | 9/1977 | Hayahusa et al. | 57/337 |
| 4,051,655 | 10/1977 | Lorenz et al. | 57/339 |
| 4,129,980 | 12/1978 | Dillon | 57/339 |
| 4,195,470 | 4/1980 | Sturhahn | 57/338 X |
| 4,297,837 | 11/1981 | Baver et al. | 57/337 X |
| 4,489,546 | 12/1984 | Schuster et al. | 57/337 X |

*Primary Examiner*—Donald Watkins

*Attorney, Agent, or Firm*—Ostrolenk, Faber, Gerb & Soffen

[57] ABSTRACT

The friction ring of a rotor or disk for a friction false-twisting device for synthetic threads is disposed on the circumference of the respective rotor. The friction ring is comprised of elastic material and is capable of lifting off the rotor upon high rotor rotation speed. To prevent lift-off, at least one annular element is disposed to the ring. In one embodiment, the annular element is rigid and is disposed in a groove around the periphery of the ring. In another embodiment, rigid annular elements are disposed in respective grooves in one or both side faces of the ring. In still another embodiment, the annular element is disposed inside the ring and may even comprise an initially tensioned spring, rather than a rigid annular element.

20 Claims, 3 Drawing Figures

FRICTION ROTOR FOR THE FALSE-TWISTING OF SYNTHETIC THREADS

BACKGROUND OF THE INVENTION

The present invention relates to the friction ring of a friction rotor for a friction false-twisting device which is used for the false-twisting of synthetic threads.

Federal Republic of Germany DE-OS No. 29 01 408 shows a friction rotor having a carrier or body, e.g. a disk, which has a V-shaped groove on its outer circumference, and a correspondingly shaped friction ring is arranged in that groove. The friction ring is snapped into the V groove with a preset initial tension. Because the friction rotor is in this form, when its friction ring becomes worn, it can be replaced with a new one, without great trouble and without damage to the carrier.

The above friction ring, however, has the disadvantage that it can only be used at low speeds of rotor rotation. At high speeds of rotation, the friction ring would lift off from the carrier body. Fatigue phenomena as well as the temperatures occurring upon the false twisting affect the unsecured friction ring and contribute to a change in its position. This strongly impairs the trueness of its rotation and roundness of its peripheral surface. Defective yarn is produced. Another disadvantage is that the avivage passes beneath a friction ring which is no longer tightly applied. This can also lead to the premature failure of the ring.

SUMMARY OF THE INVENTION

The object of the invention is to prevent the widening or lifting off of the friction ring even at high speeds of rotation.

In a friction false-twisting machine, the individual rotors are in the form of disks, each of which is carried on a respective one of a plurality of rotating spindles, as is known. Each friction rotor has an elastic friction ring on its circumference disk, for the friction false-twisting of synthetic threads. Typically, the circumferential periphery of the disk has a groove in it in which the friction ring is carried and around which the ring is arrayed. The groove has a shaped opening and the friction ring has a conformingly shaped internal profile to seat in the groove in the ring.

The problem to which the invention is addressed is the possibility that the ring will shift in or lift out of the groove, loosen or shift, and the like. To avoid this problem, a number of embodiments of the invention are disclosed. In each embodiment, at least one rigid or tensioning, annular element is disposed on or in the friction ring for rigidifying and strengthening the ring and for preventing it from lifting off its seat on the disk at high rotation speeds, or due to rubbing, or the like. Preferably, the annular element is near to or at the periphery of the elastic friction ring, that is, it extends around the periphery, or it is inside the ring just beneath the periphery. Alternatively, the annular element may be disposed on one or both of the side faces of the friction ring, and it even may be disposed at a side face in addition to an annular element located closer to the periphery of the ring.

In one embodiment, for example, the ring has a circumferential peripheral groove. In another embodiment, the ring has a plurality of such grooves. Such annular elements are each disposed in a respective one of those grooves. In yet another embodiment, the annular element comprises an annular tensioning spring which has been wound with initial tension, is installed in the ring and is then grouted or sprayed in the elastic friction ring to be embedded inside the ring near its periphery. The rigidifying or tensioning annular elements serve as securing elements for securing the friction ring to the disk or rotor.

The annular elements of the invention have the advantage that they surround the friction ring around its entire circumference and thus prevent the ring from lifting off from the carrier body or from widening. This also avoids having avivage pass beneath the friction ring, which would lead to the premature wearing out of the friction ring. High speeds of rotation can thus be used, which permit draw-off speeds of 800 meters per minute and more. Even the relatively high temperatures do not permit changes in position of the friction ring since the annular element retains the position of the ring unchanged.

Other objects and features of the invention are described below with reference to the drawings.

DESCRIPTION OF THE PREFERRED EMBODIMENTS

Figure 1:
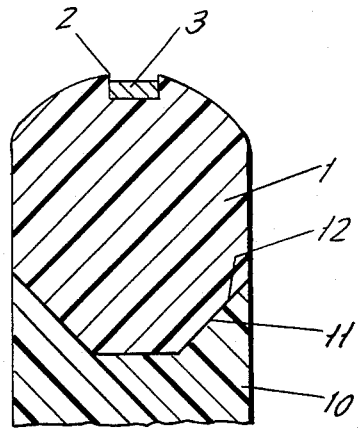
FIG. 1 shows one embodiment of a friction ring having an annular element recessed in its outer surface.

A friction ring according to the invention is used in the friction rotor of a friction false twisting apparatus as shown for example in U.S. Pat. No. 4,489,546 and allowed application Ser. No. 620,151, filed June 13, 1984, now U.S. Pat. No. 4,551,970, incorporated herein by reference to show an environment for the present invention. The fragment shown in each of the drawing Figures hereof is a fragmentary cross sectional view at the periphery of the rotor. In each case, there is a somewhat elastic friction ring on the rotor circumference, which must be retained against lifting, shifting, etc.

In FIG. 1, an annular rigidifying element 3 is inserted into the friction ring 1 at the outer circumference of the ring within the circumferential groove 2 around the periphery of the friction ring. The circumferential groove 2 around the periphery of the friction ring is of the same width as the annular element 3 for securely holding the same. The groove 2 is also shown as being deeper than the height of element 3. The friction ring may be comprised of a somewhat plastic or even a rubber material. The rigidifying element may be a metal band, a stiff plastic band, or the like stiffer material.

As can be seen in FIG. 1, the rotor or disk 10 has a groove 11 in its periphery and the internal edge 12 of the friction ring is shaped to conformingly seat in the groove 11 and is disposed in that groove. The friction ring is matingly shaped to the shape of the groove 11 in which the ring is disposed.

Figure 2:
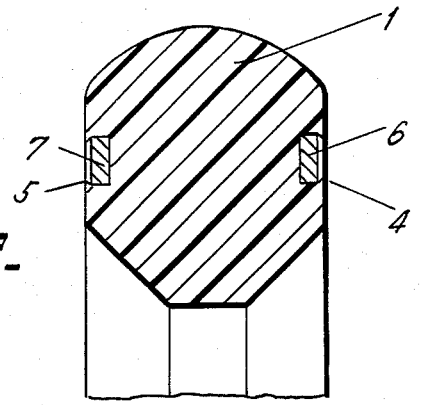
FIG. 2 shows a second embodiment of a friction ring having two annular elements recessed in its sides.

In FIG. 2, the rotor itself cannot be seen. But, only the friction ring is visible in the fragmentary cross section shown. In FIG. 2, the rigid annular elements 6 and 7 are inserted into the circumferential grooves 4 and 5 of the friction ring 1. The grooves 4 and 5 are defined in the opposite side faces of the ring 1. Here also, the grooves 4 and 5 are of the same width as but slightly deeper than the heights of the annular elements 6 and 7 which are securely supported in those grooves.

Figure 3:
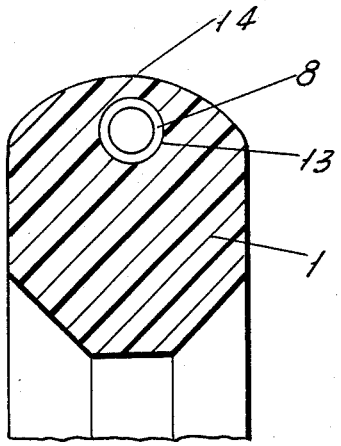
FIG. 3 shows a third embodiment of a friction ring having an annular element held in place by spraying or grouting.

In FIG. 3, a friction ring tensioning element is shown in place of a rigidifying element. The annular spring element 8, which is wound with initial tension, is inserted into an annular opening 13 defined through the friction ring, beneath and near to its outer periphery 14. After such installation, the inserted spring is secured in place, being sprayed or grouted into the opening defined in the friction ring 1. This tensioning prevents widening of the friction ring.

Although the present invention has been described in connection with a plurality of preferred embodiments thereof, many other variations and modifications will not become apparent to those skilled in the art. It is preferred, therefore, that the present invention be limited not by the specific disclosure herein, but only by the appended claims.

What is claimed is:

1. A friction rotor for friction false-twisting of synthetic threads, or the like, the rotor including an elastic material friction ring on and defining the circumference of the rotor; at least one annular element disposed on and around the friction ring for restraining the friction ring from lifting off the rotor upon high speeds of rotor rotation.

2. The friction rotor of claim 1 further comprising a rotor body having a circumference about which the friction ring is disposed and the annular element being positioned to the friction ring for holding the friction ring to the periphery of the rotor body.

3. The friction rotor of claim 2, wherein the annular element is substantially rigid.

4. The friction rotor of claim 2, wherein the annular element is initially tensioned such that the widening of the friction ring increases the tension of the annular element.

5. The friction rotor of claim 1, wherein the annular element is substantially rigid.

6. The friction rotor of claim 1, wherein the annular element is initially tensioned such that widening of the friction ring increases the tension of the annular element.

7. The friction rotor of claim 2, wherein the rigid annular element is disposed at the radially outermost periphery of the friction ring.

8. The friction rotor of claim 7, wherein the friction ring has a groove defined on the radially outermost periphery thereof and the annular element is disposed in the annular groove of the friction ring.

9. The friction rotor of claim 7, wherein the annular element is substantially rigid.

10. The friction rotor of claim 2, wherein the friction ring has opposite lateral faces and the annular element is disposed on at least one of the opposite faces of the friction ring.

11. The friction rotor of claim 10, further comprising at least two of the annular elements, and each of the two annular elements being disposed on a respective one of the opposite faces of the friction ring.

12. The friction rotor of claim 11, wherein the friction ring has a respective groove defined in each of the opposite faces of the friction ring and a respective one of the annular elements is disposed in a respective one of the grooves on each of the opposite faces of the friction ring.

13. The friction rotor of claim 11, wherein the annular element is substantially rigid.

14. The friction rotor of claim 2, wherein the annular element is disposed inside the friction ring.

15. The friction rotor of claim 14, wherein the annular element is initially tensioned such that the widening of the friction ring increases the tension of the annular element.

16. The friction rotor of claim 14, wherein the friction ring has an annular opening inside the ring and extending therearound and the annular element is disposed in the annular opening.

17. The friction rotor of claim 16, wherein the annular element comprises an annular spring disposed in the friction ring under initial tension.

18. The friction rotor of claim 17, wherein the spring is secured in the friction ring.

19. The friction rotor of claim 18, wherein the spring is secured in the friction ring by being grouted therein.

20. The friction rotor of claim 18, wherein the spring is secured in the friction ring by being sprayed therein.

* * * * *